US010704552B2

(12) United States Patent
Seaver et al.

(10) Patent No.: US 10,704,552 B2
(45) Date of Patent: Jul. 7, 2020

(54) VACUUM SYSTEM

(71) Applicant: Powerex-Iwata Air Technology Inc., Harrison, OH (US)

(72) Inventors: Gregory Ellsworth Seaver, Milan, IN (US); Joseph Anton Abt, Harrison, OH (US)

(73) Assignee: POWEREX/IWATA AIR TECHNOLOGY INC., Harrison, OH (US)

( * ) Notice: Subject to any disclaimer, the term of this patent is extended or adjusted under 35 U.S.C. 154(b) by 503 days.

(21) Appl. No.: 15/423,255

(22) Filed: Feb. 2, 2017

(65) Prior Publication Data

US 2017/0218958 A1 Aug. 3, 2017

Related U.S. Application Data

(60) Provisional application No. 62/290,127, filed on Feb. 2, 2016.

(51) Int. Cl.

| | |
|---|---|
| ***F04C 29/04*** | (2006.01) |
| ***F04C 29/06*** | (2006.01) |
| ***F04C 23/00*** | (2006.01) |
| ***F04C 18/12*** | (2006.01) |
| ***F01C 21/00*** | (2006.01) |

(52) U.S. Cl.

CPC ..... *F04C 29/063* (2013.01); *F01C 21/007* (2013.01); *F04C 18/123* (2013.01); *F04C 23/001* (2013.01); *F04C 29/04* (2013.01); *F04C 2220/12* (2013.01)

(58) Field of Classification Search

CPC ..... F04C 29/063; F04C 18/123; F04C 29/04; F04C 23/001; F04C 2220/12; F01C 21/007; F01C 21/06; F24F 2013/205; F24F 13/08; F24F 7/00–7/10

See application file for complete search history.

(56) References Cited

U.S. PATENT DOCUMENTS

| | | | | |
|---|---|---|---|---|
| 4,022,550 A * | 5/1977 | Brink | F04B 35/06 | 417/234 |
| 4,264,282 A * | 4/1981 | Crago | F04C 29/066 | 181/202 |
| 4,733,750 A * | 3/1988 | Poirier | F02B 63/04 | 181/202 |
| 5,199,858 A * | 4/1993 | Tsuboi | F04B 39/04 | 417/362 |

(Continued)

OTHER PUBLICATIONS

Plant Engineer's Handbook, by Mobley, published 2001 (Year: 2001).*

(Continued)

*Primary Examiner* — Charles G Freay
*Assistant Examiner* — Thomas Fink
(74) *Attorney, Agent, or Firm* — Tarolli, Sundheim, Covell & Tummino LLP; John A. Yirga, Esq.

(57) ABSTRACT

A vacuum system is disclosed. The vacuum system includes a first pump bay and a second pump bay enclosed by an enclosure. Each pump bay houses a motor and a vacuum pump driven by the motor. An inlet manifold and an exhaust manifold are in fluid communication with the first and second pump bays. The inlet manifold and the exhaust manifold are arranged to flow air through the pump bays to cool at least the vacuum pumps.

20 Claims, 7 Drawing Sheets

(56) References Cited

U.S. PATENT DOCUMENTS 5,332,872 A * 7/1994 Ewanek ..... F04D 29/663 181/224
2005/0013704 A1* 1/2005 Dyson ..... F01C 21/007 417/364
2005/0063844 A1* 3/2005 Sato ..... F01C 21/007 417/423.5
2006/0055193 A1* 3/2006 Colborne ..... B60P 3/14 296/24.3
2006/0170314 A1* 8/2006 Ricker ..... F01C 21/007 312/290
2006/0180396 A1* 8/2006 Ricker ..... F01C 21/007 184/106
2006/0180397 A1* 8/2006 Ricker ..... F01C 21/007 184/106
2008/0145258 A1* 6/2008 Metzger ..... F04C 29/04 418/88
2009/0033186 A1* 2/2009 Ricker ..... F04B 39/0033 312/236
2009/0186571 A1* 7/2009 Haro ..... H01L 21/67017 454/241
2010/0116583 A1* 5/2010 Seedorf ..... F04B 53/002 181/205
2010/0172093 A1* 7/2010 Davis ..... H05K 7/20572 361/694
2014/0246863 A1* 9/2014 Vallinayagam ..... H02K 9/02 290/1 B
2014/0314586 A1* 10/2014 Kanaizumi ..... F04C 23/001 417/362
2015/0329125 A1* 11/2015 Mizufune ..... B61D 27/0072 165/122
2017/0321699 A1* 11/2017 Kawano ..... F04C 29/04

OTHER PUBLICATIONS

C-Series Claw Vacuum Pumps and Compressors, by Gardner Denver, published 2011 (Year: 2011).*
Powerex URL: https://web.archive.org/web/20130510150419/http://pdf.medicalexpo.com/pdf/powerex/nnedical-vacuum-claw/78598-78599.html (Year: 2013).*

* cited by examiner

VACUUM SYSTEM

CROSS-REFERENCE TO RELATED APPLICATIONS

The present application claims priority to U.S. Provisional Patent Application Ser. No. 62/290,127 filed Feb. 2, 2016 entitled VACUUM SYSTEM, the entire contents of which are incorporated herein by reference in its entirety for all purposes.

FIELD OF THIS DISCLOSURE

The present disclosure relates to a vacuum system. More specifically, the present disclosure relates to a vacuum system having a sound trapping enclosure with features that facilitate airflow through the enclosure to manage any heat and/or noise generated during operation of the vacuum system.

BACKGROUND

Vacuum systems are widely utilized in the medical, laboratory, and industrial fields. The vacuum systems are typically constructed of one or more vacuum pumps mounted on a frame and operated from a single control panel. Each vacuum pump is a unitized assembly of the pump and the motor used to drive the pump, both of which can generate significant noise and heat during operation.

Similarly, the medical, laboratory, and industrial fields also use air compressor systems that are constructed out of one more pumps mounted on a frame. The operation of the pumps can likewise generate significant noise during operation. Manufactures have attempted to solve the noise generation issue in air compressor systems by providing the compressor pumps and associated motors in a sound reducing enclosure.

It is known in the art to provide a single lubricated rotary vane pump in a sound reducing enclosure. However, medical, laboratory, and some specialized industrial fields require the use of oilless vacuum pumps. One type of oilless vacuum pump is known as a "claw vacuum" pump. The claw vacuum pump is generally known to generate a greater amount of heat and noise compared to a single lubricated vane pump or conventional vacuum pump. Thus, it has been generally impossible to enclose a claw vacuum pump to reduce the noise because of heat related issues.

SUMMARY

One aspect of the present disclosure comprises a vacuum system including a frame and a plurality of panels attached to the frame to define an enclosure. A first pump bay and a second pump bay are enclosed by the enclosure. The first pump bay and the second pump bay each house a motor and a vacuum pump driven by the motor. An inlet manifold that bridges an interior and exterior of the enclosure is in fluid communication with the first and second pump bays when in use. The inlet manifold is arranged to extract ambient air from the environment surrounding the vacuum enclosure and deliver the ambient air to the pump bays when in use. The ambient air flows through the first and second bays to cool at least the vacuum pump and subsequently become heated air when in use. An exhaust manifold that bridges an interior and exterior of the enclosure is in fluid communication with the first and second pump bays. The exhaust manifold includes at least one fan arranged to extract the heated air from the first and second pump bays and expel the heated air back into the environment surrounding the vacuum enclosure when in use.

Another aspect of the present disclosure comprises a method of generating a vacuum system. The method comprises enclosing at a first motor and a first vacuum pump in a first pump bay and enclosing a second motor and a second vacuum pump in a second pump bay. The first pump bay and the second pump bay are enclosed by an enclosure defined by a plurality of panels attached to a frame. The method further includes forming an inlet manifold through at least a portion of the enclosure to extract ambient air from the environment surrounding the enclosure and to deliver the ambient air to the first and second pump bays when in use. The ambient air flowing through the first and second pump bays cools at least the vacuum pump and subsequently becomes heated air when in use. The method additionally includes forming an exhaust manifold through at least a portion of the enclosure. The exhaust manifold comprises at least one fan, and is in fluid communication with the first and second pump bays when in use. Further, the exhaust manifold is arranged to extract the heated air from the first and second pump bays and expel the heated air back into the environment surrounding the enclosure when in use.

Yet another aspect of the present disclosure includes a vacuum system comprising a plurality of panels attached to a frame to define an enclosure, a first pump bay and a second pump bay enclosed by the enclosure. The first pump bay and the second pump bay each include a motor and a vacuum pump driven by the motor. The vacuum system also includes an inlet manifold comprising at least one baffle arranged to prevent the emission of sound when in use. The inlet manifold, formed through at least a portion of the enclosure, is in fluid communication with the first and second pump bays when in use and is arranged to extract ambient air from the environment surrounding the vacuum enclosure and deliver the ambient air via an approximately 90° turn to the pump bays, the ambient air flowing through the first and second bays cools at least the vacuum pump and subsequently becomes heated air when in use. The vacuum system further includes an exhaust manifold, formed through at least a portion of the enclosure, in fluid communication with the first and second pump bays when in use. The exhaust manifold, including at least one fan, is arranged to extract the heated air from the first and second pump bays, wherein the heated air turns approximately 90° to travel from the pump bays to the exhaust manifold when in use, and wherein the heated air turns approximately 90° to be expelled into the environment at a location spaced from the inlet manifold and in a direction away from the inlet manifold when in use.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
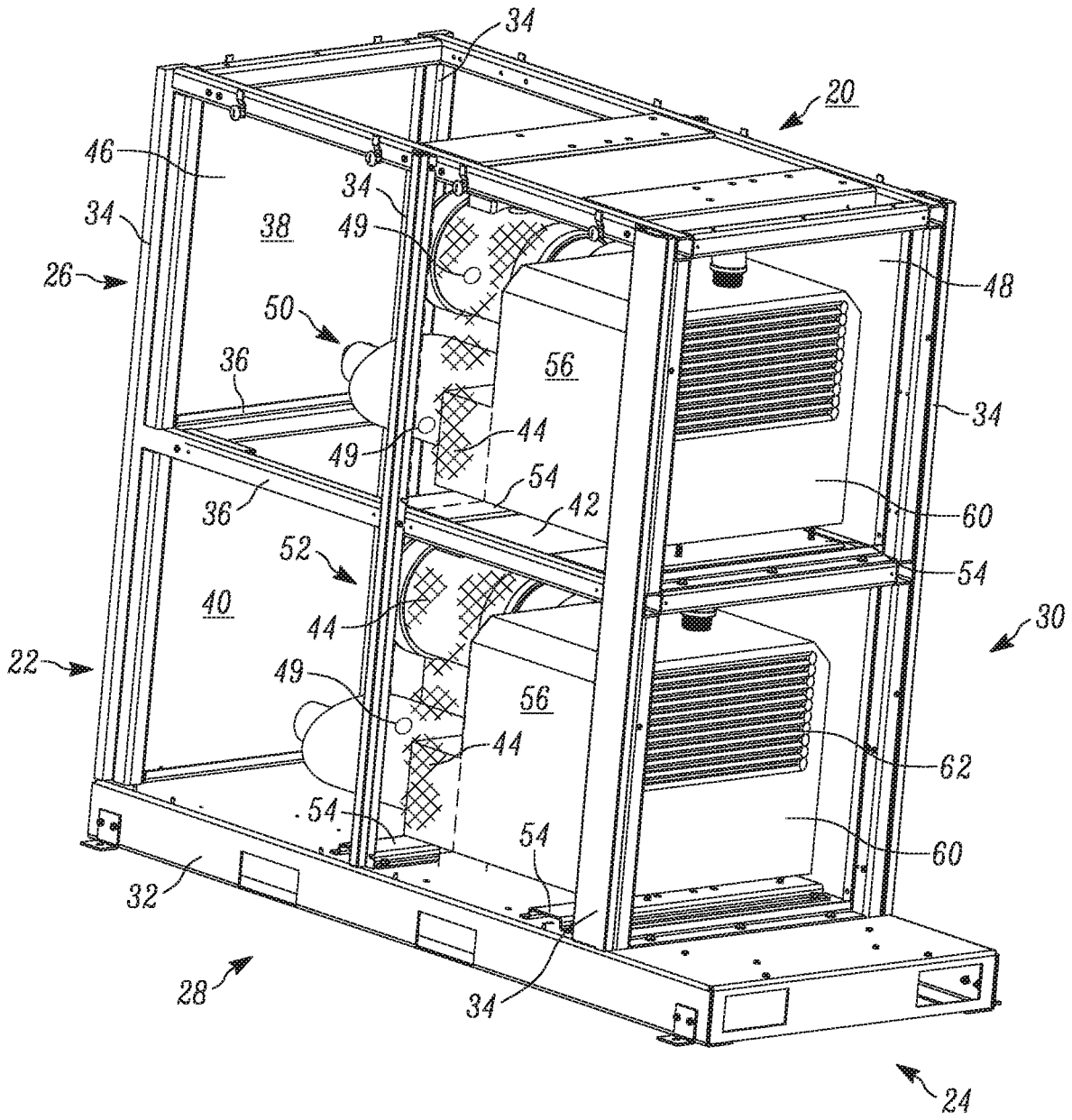
FIG. 1 is right side perspective view of a vacuum system in accordance with one example embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a vacuum system 20. The vacuum system 20 can be used to provide a desired vacuum in the medical, laboratory, and/or industrial fields.

Figure 2:
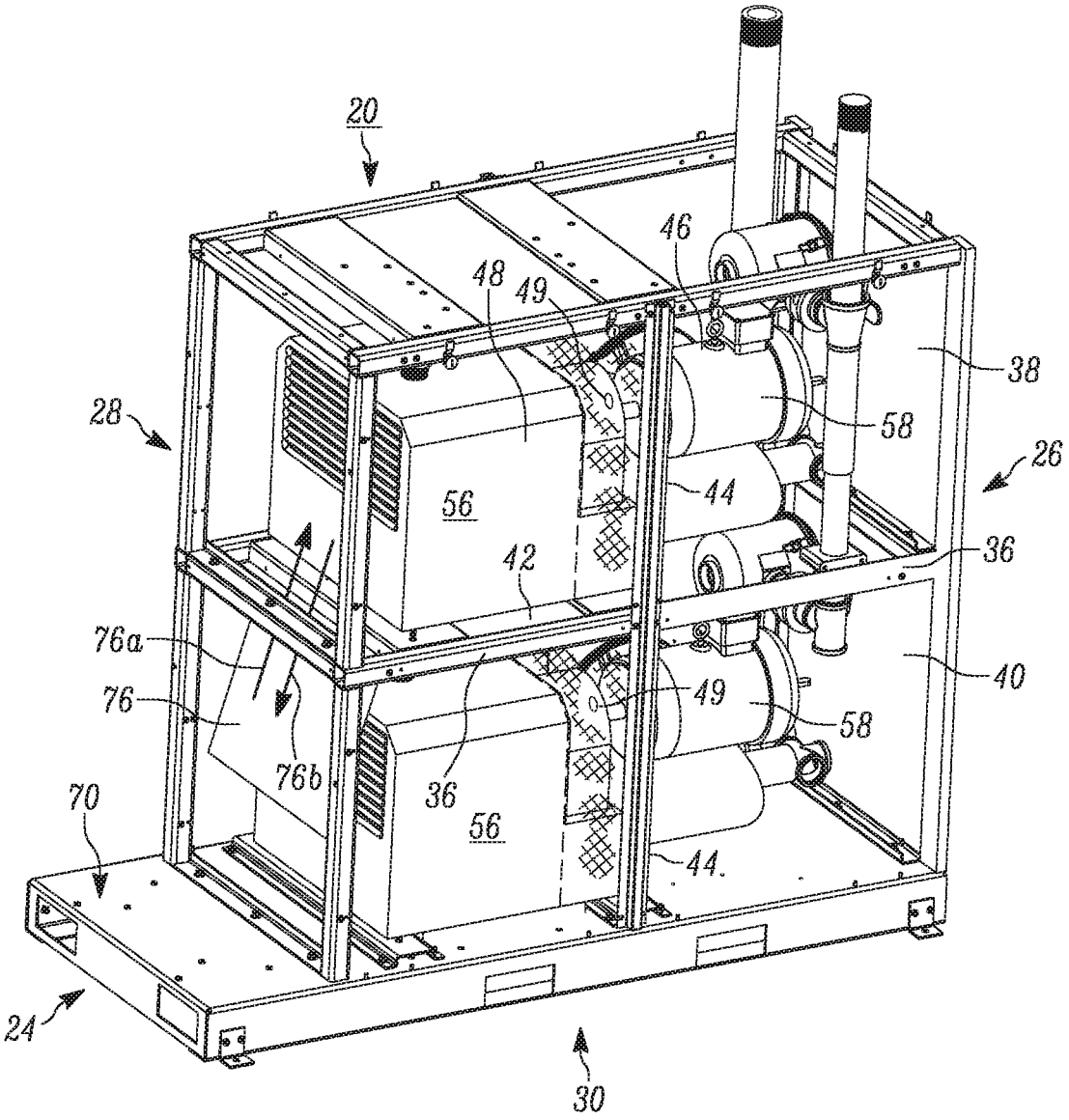
FIG. 2 is a left side perspective view of the vacuum system of FIG. 1.
Figure 3:
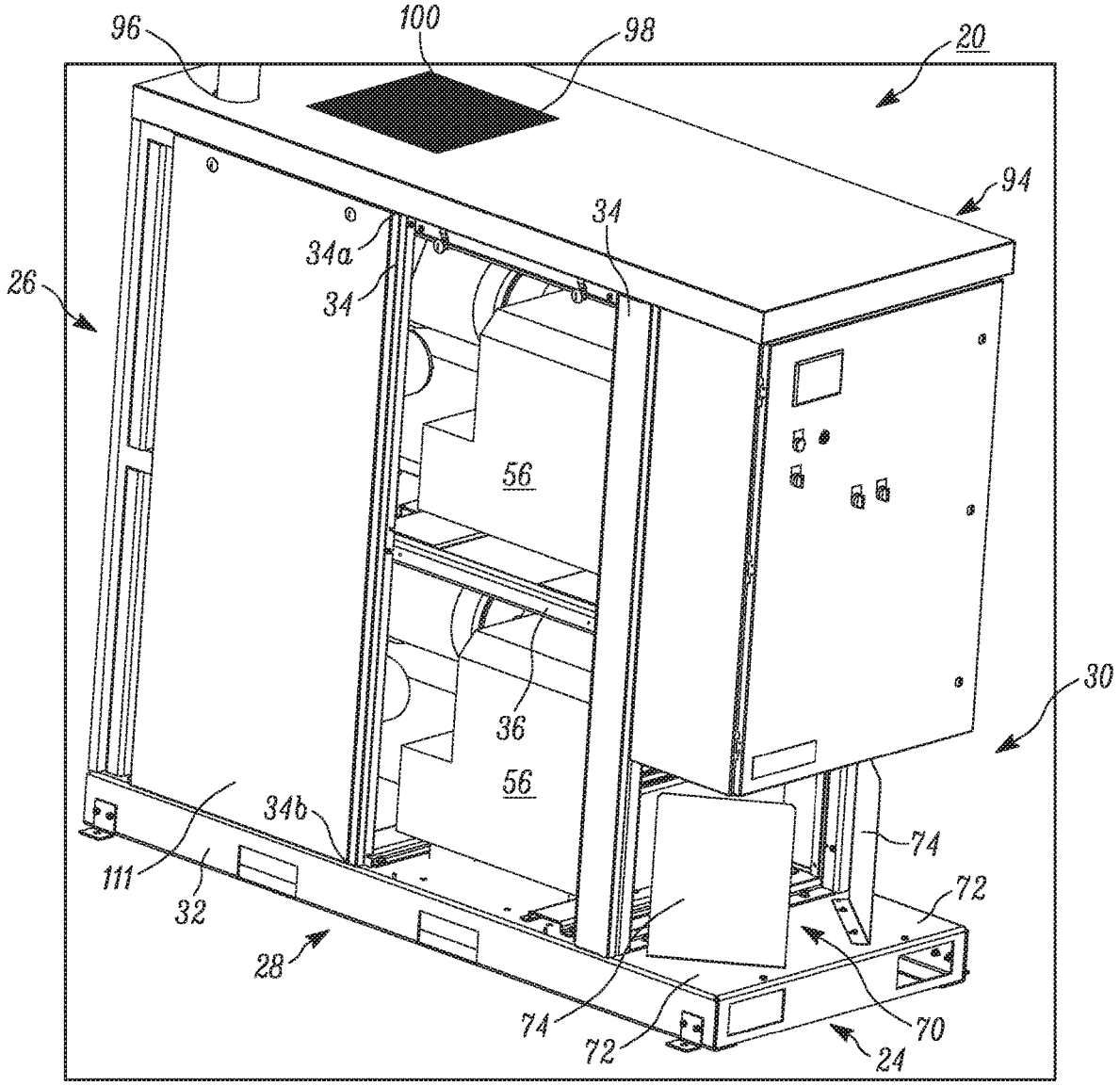
FIG. 3 is a right side perspective view of the vacuum system of FIG. 1 showing the control panel and exhaust ducting cover mounted to the frame.

Referring to FIGS. 1-3, the vacuum system 20 includes a frame 22 having a front side 24, a rear side 26, a right side 28, and a left side 30. The terms "front side", "rear side", "right side", and "left side" are used only to provide clarity to the description of the vacuum system 20 and do not in any way add limitations to the vacuum system. The frame 22 has a base platform 32 to which a plurality of vertical columns 34 are attached. Horizontal beams 36 are attached to the columns 34. The base platform 32, the columns 34, and the beams 36 are arranged to delineate the vacuum system 20 into a first bay 38 and a second bay 40. Although two bays are shown in the example embodiment, the vertical beams 34 may be extended and additional horizontal beams 36 may be included to provide additional bays. A horizontal divider panel 42 is attached to the frame 22 and extends substantially parallel to the beams 36 from the front 24 to the rear 26. The horizontal divider panel 42 separates the first bay 38 from the second bay 40, without restriction within the bays. Alternatively, in the illustrated example embodiment, a vertical divider panel 44, shown in partially transparent hatching, is provided in each of the bays 38, 40 and is attached to the frame 22. The vertical divider panel 44 extends substantially parallel to the vertical columns 34 and separates each bay into a general equipment space 46 and a pump space 48. The vertical divider panel 44 includes at least one passage 49 that provides fluid communication between the general equipment space 46 and the pump space 48.

The first bay 38 and the second bay 40 are provided with a first pump unit 50 and a second pump unit 52, respectively. The first pump unit 50 and the second pump unit 52 are each secured to support beams 54 that are attached to at least one of the base platform 32 and the horizontal beams 36, respectively. The support beams 54 extend between the left side 30 and right side 28 of the frame 22 and support the pump units 50, 52 in the respective bays 38, 40. Each pump unit 50, 52 includes a motor 58 and a pump 56 (see FIG. 2) for driving the pump. In the example embodiment, the pumps 56 are of the substantially same configuration (e.g., have the same horsepower rating, power requirements, etc.) and the motors 58 are substantially identical claw vacuum pumps. An example of a suitable claw vacuum pump is one manufactured by Gardner Denver of Milwaukee, Wis., Elmo Rietshcle Division in Germany under model numbers VLR-301 VLR 251, and VLR-150. The VLR-301 model claw vacuum pump operates with a process discharge temperature of 275° F. degrees Fahrenheit and a noise level of over 77 dba sound rating. However, the motors 58 may be any other desired vacuum pump, and a different combination of motors and pumps may be used in each bay. The pump units 50, 52 are arranged such that the motor 58 is substantially located in the general equipment space 46 of each bay and the pump 56 is substantially located in the pump space 48 of each bay. In one embodiment, the pump 56 is located in the general equipment space 46 and the motor 58 is located in the pump space 48.

The pump 56 is provided with a shroud 60 that includes a plurality of slits 62. The shroud 60 substantially isolates the pump 56 from the rest of the pump space 48 of the respective bay. An inlet conduit 64 and an outlet conduit 66 (see FIGS. 4, 6, and 7) are connected to the motors 58. In the example embodiment, the inlet conduit 64 and the outlet conduit 66 are shared by the motors 58 (i.e., the inlet conduit 64 and outlet conduit 66 are in fluid communication with both of the motors 58) and extend substantially parallel to the vertical beams 34 of the frame 22. However, each motor 58 may be provided with a separate inlet conduit and outlet conduit, and the conduits may have any other suitable orientation. As shown in the illustrated embodiment of FIG. 6, a valve 68 is provided at the junction of the conduits 64, 66 and the motors 58. The valve 68 can be operated to interrupt fluid communication between the conduits 64, 66 and the motors 58.

Referring to FIGS. 2 and 3, a cooling intake manifold 70 is provided at the front side 24 of the frame 22 on the base platform 32. The cooling intake manifold 70 includes two inlets 72. Although two inlets 72 are shown in the example embodiment, a fewer or greater number of inlets may be provided to the cooling intake manifold 70. A baffle 74 is provided at each of the inlets 72. The baffle 74 is configured and arranged to discourage the emission of sound from the inlets 72 of the cooling intake manifold 70. In the example embodiment, a single baffle 74 is provided at each inlet 72 and arranged at a non-parallel angle relative to the horizontal beams 36 located on the right side 28 and the left side 30 of the frame 22. However, a plurality of baffles may be provided having any suitable orientation. Additionally, in one example embodiment, the baffle 74 (or baffles) are provided with sound absorbing material (e.g., foam) to further reduce the emission of noise from the inlets 72 of the cooling intake manifold 70. A cooling duct 76 (see FIGS. 2 and 6) is provided in the cooling intake manifold 70. The cooling duct 76 is arranged inside the cooling intake manifold 70 to distribute ambient air between the first bay 38 and the second bay 40 in a desired manner (e.g., the ambient air is distributed between the first and second bays as indicated by arrows 76*a*, 76*b*).

Figure 5:
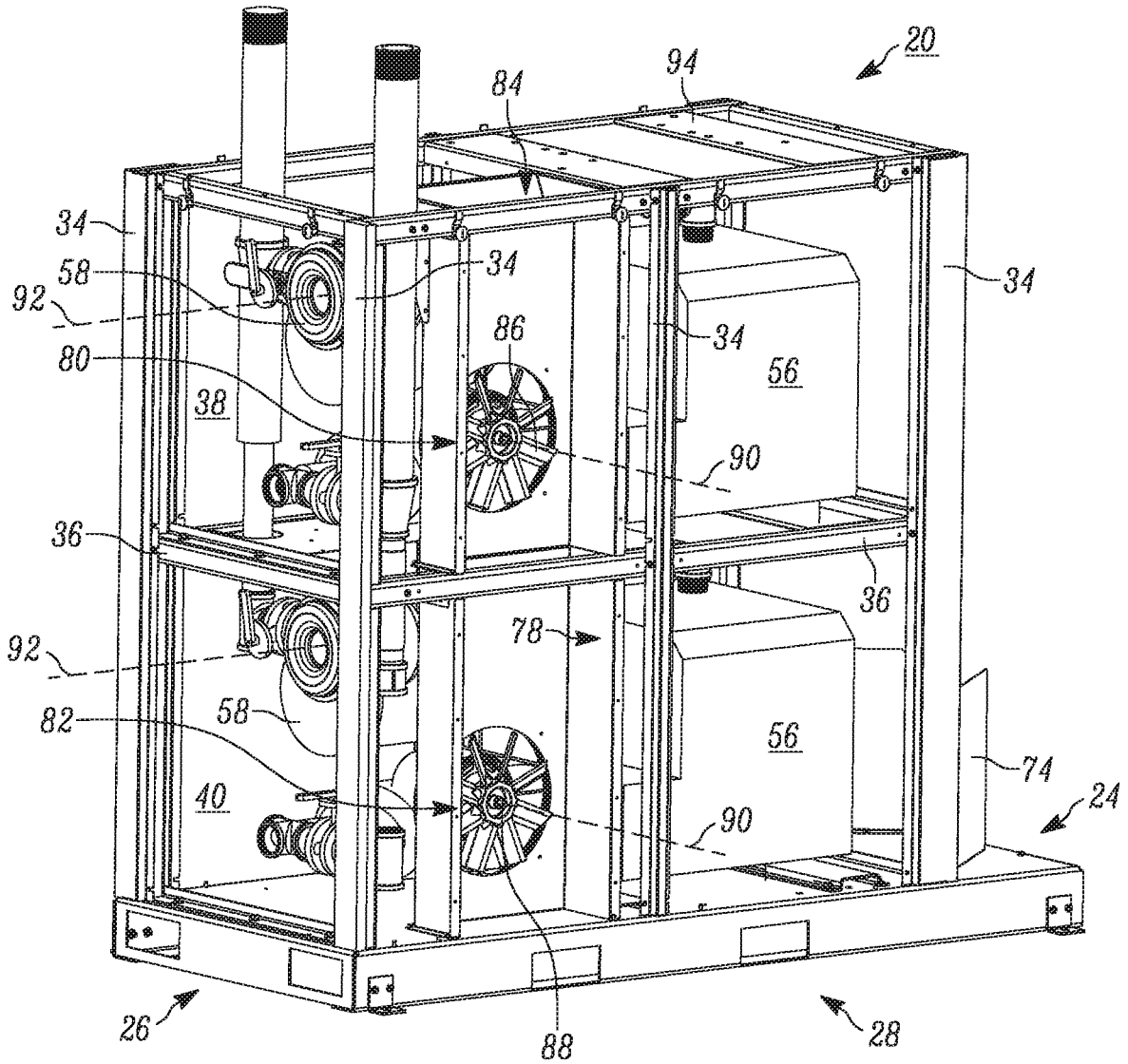
FIG. 5 is a right side rear view of the vacuum system of FIG. 1 showing the exhaust ducting and associated components mounted to the frame and the ambient air supply and compressed air supply lines.
Figure 6:
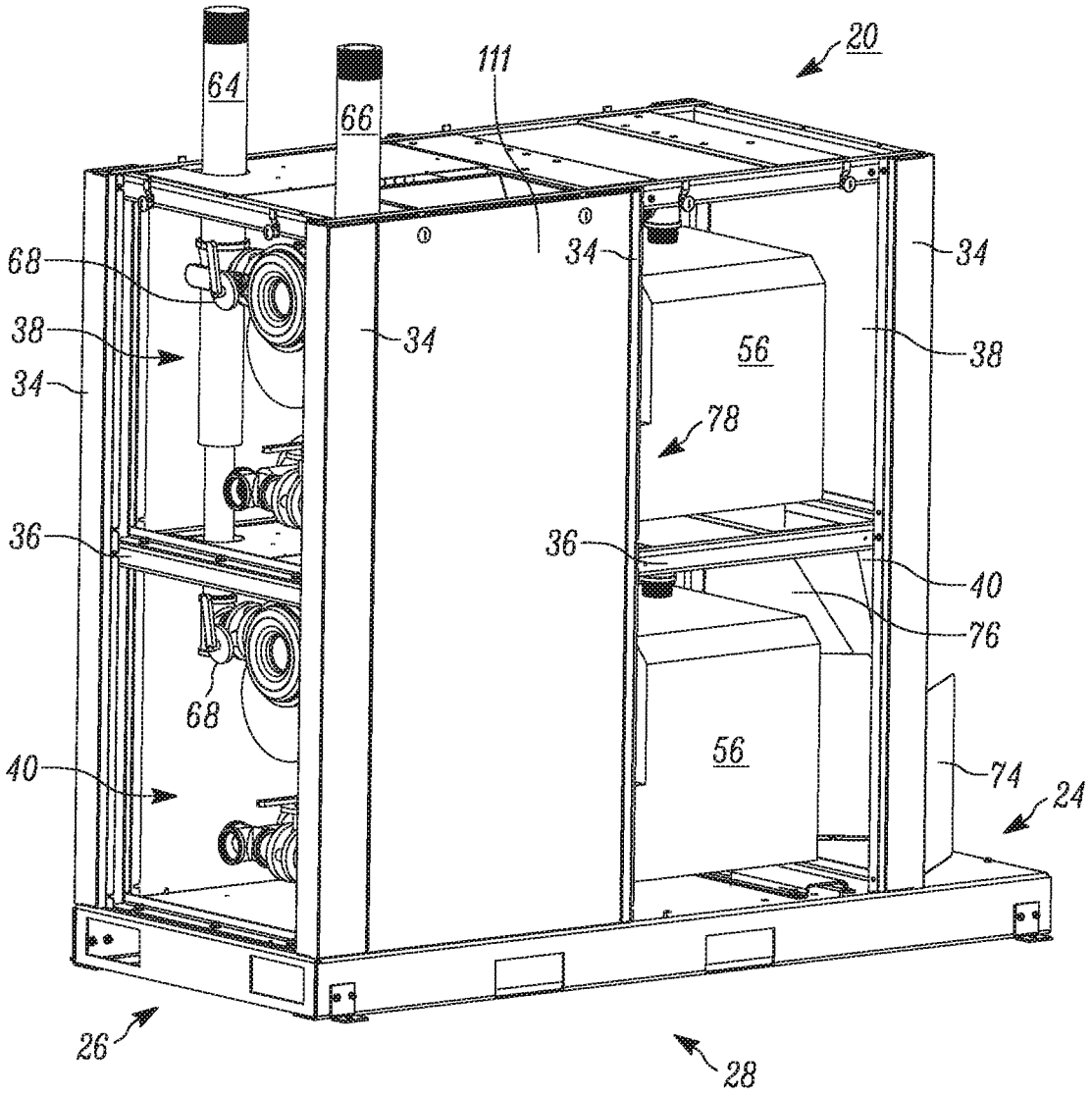
FIG. 6 is a right side rear view of the vacuum system of FIG. 1 showing the exhaust ducting cover mounted to the exhaust ducting.
Figure 7:
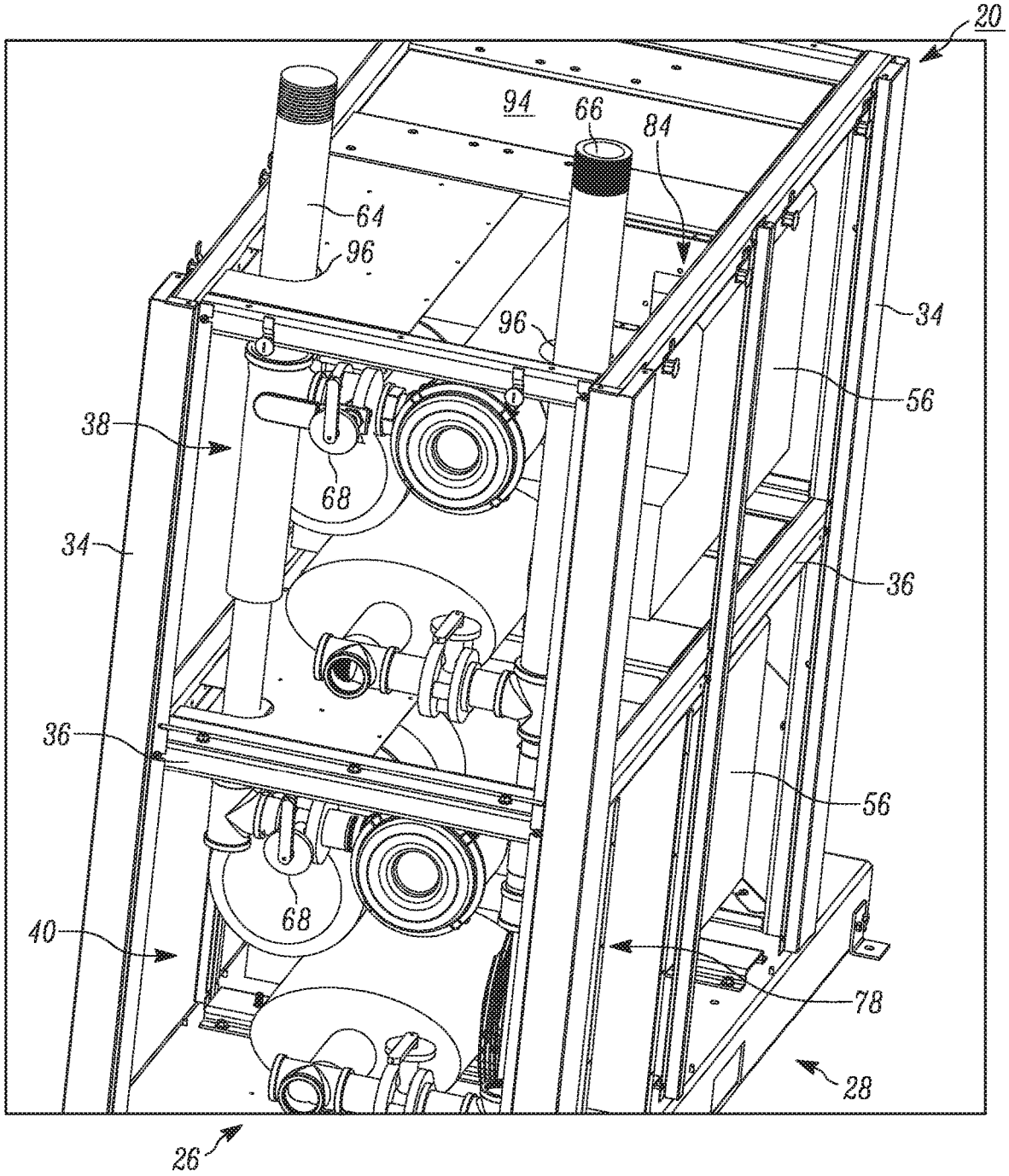
FIG. 7 is a top perspective view of the vacuum system of FIG. 1.

Referring to FIGS. 5-7, a cooling exhaust manifold 78 is provided on the right side 28 of the frame 22 toward the rear side 26. The cooling exhaust manifold 78 is attached to at least the horizontal beams 36 of the frame 22 and extends substantially parallel relative to the vertical beams 34. The example embodiment includes only a single cooling exhaust manifold 78. However, additional cooling exhaust manifolds may be provided. In the illustrated example of FIG. 5, the cooling exhaust manifold 78 includes a first inlet 80 in fluid communication with the first bay 38 and a second inlet 82 in fluid communication with the second bay 40. An exhaust outlet 84 is provided at a terminal end of the cooling exhaust manifold 78. Although not illustrated, one or more baffles may be provided in the cooling exhaust manifold 78 to discourage the emission of sound from the exhaust outlet 84. In one example embodiment, the one or more baffles are provided with sound absorbing material (e.g., foam) to further reduce noise emission.

The first and second inlets 80, 82 of the cooling exhaust manifold 78 are provided with a first exhaust fan 86 and a second exhaust fan 88, respectively. It is preferable to have the fans 86, 88 oriented such that an axis 90 about which each fan rotates is substantially perpendicular to an axis 92 of rotation of each motor 58. However, the axis 90 of rotation of the fans 86, 88 may have any other suitable orientation relative to the axis 92 of rotation of the motor 58. Additionally, the fans 86, 88 are of sufficient size and located sufficiently close to the pump motors 58 to maintain a desired airflow. However, other fan arrangements are contemplated. For example, additional ductwork provided in the cooling exhaust manifold 78 (e.g., on the left side 30 of the frame 22) to facilitate airflow are contemplated.

Figure 4:
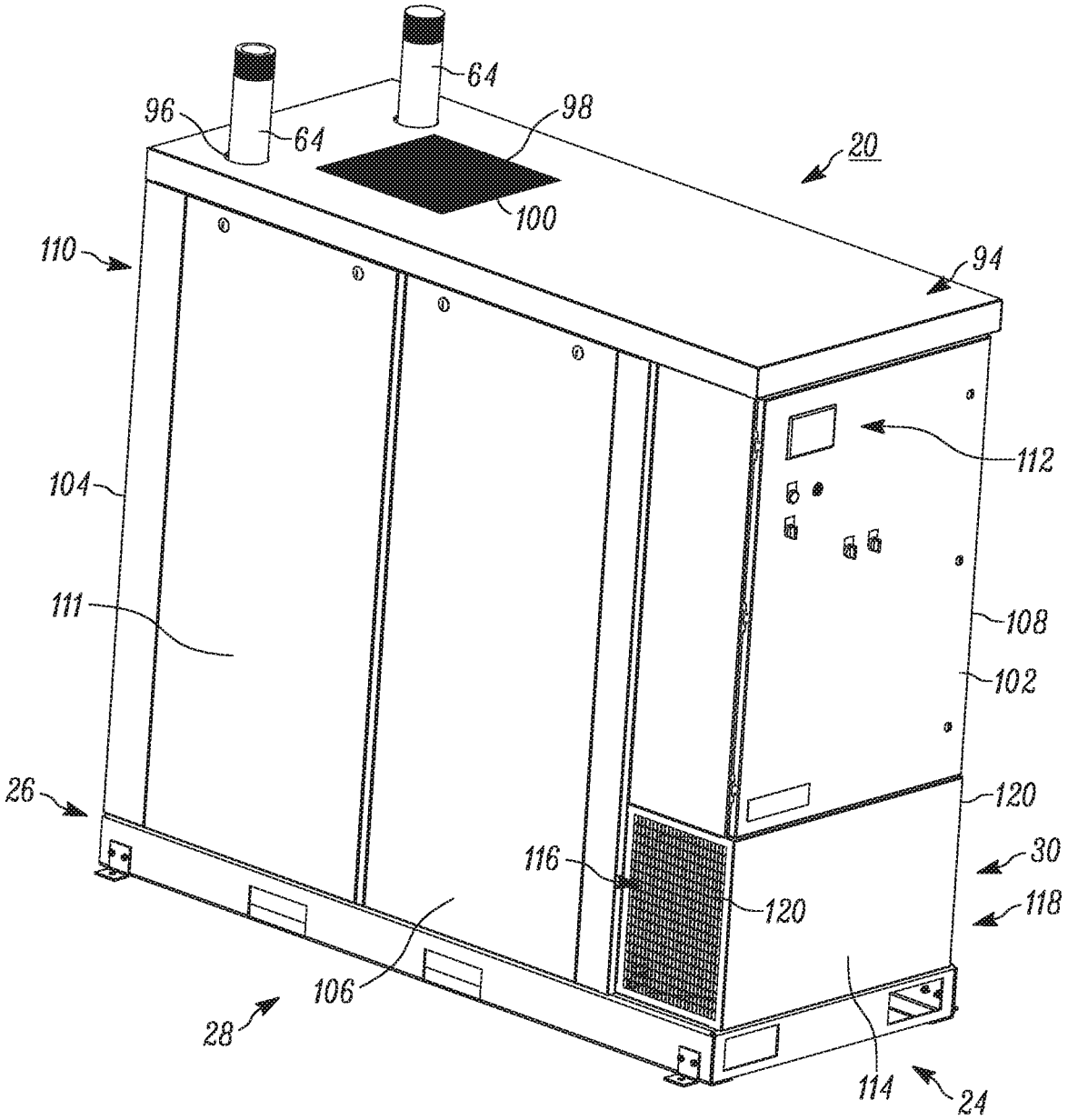
FIG. 4 is a right side perspective view of the vacuum system of FIG. 1 showing the sound reducing panels mounted to the frame.

Referring now to FIGS. 3 and 4, a frame roof 94 is attached to at least an end 34*a* of the vertical beams 34 that are opposite to an end 34*b* of the vertical beams 34 to which the base platform 32 is attached. Openings 96 through which the inlet conduit 64 and the outlet conduit 66 pass are provided on the frame roof 94. The frame roof 94 includes an enclosure outlet 98 that is in fluid communication with the exhaust outlet 84 of the cooling exhaust manifold 78 (see FIG. 5). The enclosure outlet 98 is provided with a grill 100 that prevents foreign debris from inadvertently entering the vacuum system 20. Is shown in the illustrated example embodiment of FIG. 4, a front exterior panel 102, a rear exterior panel 104, a right exterior panel 106, and a left exterior panel 108 are attached to the frame 22 at the front side 24, rear side 26, right side 28, and left side 30, respectively. The front, rear, right, and left exterior panels 102, 104, 106, 108 form an enclosure 110 that substantially encloses the first and second pump bays 38, 40. In one example embodiment, the exterior panels 102, 104, 106, 108 are provided with sound absorbing material. An exhaust cover 111 is attached to the cooling exhaust manifold 78. As shown in the example embodiment illustrated in FIG. 4, the exhaust cover 111 is separate from the right exterior panel 106. However, the exhaust cover 111 may be integral with the right exterior panel 106. In one example embodiment, the exhaust cover 111 is provided with sound absorbing material. All of said panels in one example embodiment are formed of metal and include sound absorbing material adhered on the inside wall of the enclosure of the vacuum system 20.

A control panel 112 is provided to control various operating parameters of the vacuum system 20 (see FIG. 4). In the example embodiment, the control panel 112 is integrated into the front exterior panel 102. However, in another example embodiment, the control panel 112 is integrated into one of the rear exterior panel 104, the right exterior panel 106, or the left exterior panel 108. In yet another example embodiment, the control panel 112 is a standalone unit that is completely separate from the remainder of the vacuum system 20.

An intake manifold cover 114 is provided to enclose the cooling intake manifold 70. In the example embodiment, the intake manifold cover 114 is separate from the exterior panels 102, 104, 106, 108. However, in another example embodiment, the intake manifold cover 114 is integral with the neighboring exterior panels (e.g., the front, right, and left exterior panels 104, 106, 108). The intake manifold cover 114 includes a right side enclosure inlet 116 and a left side enclosure inlet 118 (inlet 118 being the mirror image of inlet 116). The enclosure inlets 116, 118 are in fluid communication with the respective cooling intake manifold inlets 72. Although the enclosure inlets 116, 118 are shown as being provided on the right side 28 and the left side 30 of the frame 22, the enclosure inlets may be provide at any other suitable location (e.g., the front or rears side 24, 26). Each inlet 116, 118 is provided with a grill 120 that prevents foreign debris from inadvertently entering the vacuum system 20.

Now referring to the figures in general, in one example embodiment, an operator interacts with the control panel 112 to manage operation of the vacuum system 20. During operation of the vacuum system 20, the motors 58 are energized to drive the pumps 56 such that air is drawn in through the inlet conduit 64 and expelled from the outlet conduit 66 in order to provide a vacuum at a desired location. Noise generated by the pumps 56 and the motors 58 is substantially confined within the vacuum system 20 due to the exterior panels 102, 104, 106, 108, frame roof 94, baffles 74, orientation of the intake manifold 75, orientation of the exhaust manifold 78, and any provided sound absorbing materials. Operating the vacuum system 20 causes the pumps 56 and motors 58 to generate heat. This generated heat is discharged from the vacuum system 20 to ensure continued desired performance of the vacuum system. An open air vacuum system (e.g., a system without exterior panels) would be able to adequately discharge the generated heat via only radiation. However, the exterior panels 102, 104, 106, 108 and frame roof 94 absent the airflow provided by the cooling intake manifold 70, the inlet conduit 64, the outlet conduit 66, the cooling exhaust manifold 78, etc., may trap heat within the vacuum system 20. The airflow arrangement of the present disclosure facilitates removal of the otherwise trapped heat by providing airflow through the vacuum system 20 in the following manner.

Air is drawn in from the ambient environment into the vacuum system 20 through the left and right side enclosure inlets 116, 118, the cooling manifold inlets 72, and into the cooling intake manifold 70. Although not illustrated, in one example embodiment, the cooling intake manifold 70 is provided with an intake fan (or plurality of intake fans) to assist in the intake of air from the ambient environment.

From the cooling intake manifold 70, the air is distributed to the first bay 38 and the second bay 40 by the cooling duct 76 (see FIG. 2). In one example embodiment, the control panel 112 is arranged to adjust the cooling duct 76 to provide a desired amount of air to each of the bays 38, 40. For example, if the first pump unit 50 is under a greater load than the second pump unit 52, then it would be desirable to direct a greater quantity of air toward the first bay 38 as compared to the second bay 40. In another example embodiment, if the first pump unit 50 is turned off for maintenance reasons, then it would be desirable to adjust the cooling duct 76 such that no air flow is directed toward the first bay 40. In an alternative example embodiment, the control panel 112 is arranged such that the cooling duct 76 is in a fixed position.

The air directed by the cooling duct 76 passes into the pump space 48 of the bays 38, 40 and into the shroud 60 via the slits 62. The air passing through the shroud 60 provides cooling to the pump 56 contained therein by way of convection. The air, now carrying heat from the pumps 56, is drawn into the general equipment space 46 of the bays 38, 40 through the vertical divider panel passages 49 by the exhaust fans 86, 88.

The exhaust fans 86, 88 extract the heated air from the general equipment space 46 of the bays 38, 40 and force the air into the cooling exhaust manifold 78. The heated air travels through the cooling exhaust manifold 78, past the exhaust outlet 84, and exits the vacuum system 20 via the enclosure outlet 98 provided on the frame roof 94. The orientation and construction of the fans, manifolds, panels, baffles, and system 20 reduces the heat such that a claw vacuum pump can be enclosed as described. Moreover, the orientation and construction of the fans, manifolds, panels, baffles, and system 20 are in such a way to minimize the noise of the system to allow for operation in a lab or hospital. In one test operating two claw vacuum motors and pumps, the noise to the outside of the enclosure system 20 was less than 69 dba, while the temperature remained at 108° F. degrees Fahrenheit within the enclosure having an outside ambient temperature of 87° F. degrees Fahrenheit.

The above disclosed vacuum system 20 advantageously reduces the emission of noise while also providing desired heat management. The particular arrangement of the vacuum system 20 ensures that sound emission is minimized. The exterior panels 102, 104, 106, 108, the frame roof 94, the baffles 74, and any sound absorbing material each contribute to the minimal emission of sound. Additionally, the particular pathway along which the air must flow through the vacuum system 20 further contributes to the minimal emission of sound. For example, upon exiting the pump space 48 of the bays 38, 40, the air must "turn" (i.e., change direction) approximately ninety degrees at least three times (e.g., at the cooling exhaust manifold 78, at the exhaust fans 86, 88, and at the exhaust outlet 84) before exiting from the vacuum 20, thereby capturing sound inside the system 20.

The particular arrangement of the vacuum system 20 also ensures that overheating concerns of the motors 58 and pumps 56 are minimized. The arrangement of the cooling intake manifold 70, the first and second bays 38, 40, and the cooling exhaust manifold 78 provides adequate airflow passing through the system to ensure optimal operation of the motors 58 and the pumps 56. The cooling intake manifold 70 and cooling exhaust manifold 78 are each configured to minimize flow resistance while also ensuring minimal noise transmission so as to not conflict with the reduction of sound emission previously discussed. Additionally, the fans 86, 88 are selected to provide appropriate performance characteristics (e.g., cubic feet of air moved per minute (CFM)) that ensure adequate airflow to cool the motors 58 and the pumps 56. Other features of the vacuum system 20 further contribute to the cooling abilities of the system 20. For example, the layout out of the cooling fans 86, 88 relative to the motors 58 maximizes conveyance of heat away from the pump bays 38, 40. In another example embodiment, the distance between the enclosure inlets 116, 118 and the enclosure outlet 98 is maximized such that the vacuum system 20 does not inadvertently intake heated air that has just been expelled.

A further advantage provided by the present arrangement is the ability to disperse the heat generated by the system 20 in a controlled and desired manner. In open vacuum systems, heat is dispersed in all directions. A serviceable environment can only be maintained in open vacuum systems through the use of entire room cooling and ventilation. With the vacuum system 20 of the present disclosure, ductwork and fans can be arranged to extract the air directly from the enclosure outlet 98 and be conveyed to a desired location.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected or in contact, although not necessarily directly and not necessarily mechanically. A device or structure that is "configured" in a certain way is configured in at least that way, but may also be configured in ways that are not listed. The term "in fluid communication" as used herein is defined as having at least one path through which gas and/or liquids can travel between at least two spaces.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A vacuum system comprising:

a frame;

a plurality of panels attached to the frame and defining an enclosure; a first pump bay and a second pump bay enclosed by the enclosure, the first pump bay and the second pump bay each for including a motor and a vacuum pump driven by the motor during use;

an inlet manifold bridging an interior and exterior of the enclosure, the inlet manifold in fluid communication with the first and second pump bays and arranged to extract ambient air from the environment surrounding the vacuum enclosure and deliver the ambient air to the pump bays when in use, the ambient air flows through the first and second bays to cool at least the vacuum pump and subsequently become heated air when in use, the first and second bays connected by a cooling opening that provides an airflow path between the first and second pump bays, and a baffle located in the first pump bay wherein the baffle directs air through the cooling opening; and an exhaust manifold bridging an interior and an exterior of the enclosure, the exhaust manifold in fluid communication with the first and second pump bays when in use, the exhaust manifold including at least one fan arranged to extract the heated air from the first and second pump bays and expel the heated air back into the environment surrounding the vacuum enclosure.

2. The vacuum system according to claim 1, wherein at least one of the inlet manifold and the exhaust manifold includes at least one baffle arranged to prevent the emission of sound generated by at least one of the motor and the vacuum pump to the environment surrounding the vacuum enclosure.

3. The vacuum system according to claim 2, wherein at least one of the plurality of panels and the at least one baffle is provided with a sound absorbing material.

4. The vacuum system according to claim 1, further comprising a vacuum pump wherein said vacuum pump is an oilless claw vacuum pump.

5. The vacuum system according to claim 1, wherein each pump bay includes a divider that separates each pump bay into a pump space and a general equipment space, a pump and a motor being arranged in each pump bay such that the pump is substantially located in the pump space and the motor is substantially located in the general equipment space.

6. The vacuum system according to claim 5, wherein the ambient air passing through the vacuum system passes through the general equipment space before passing through the pump space.

7. The vacuum system according to claim 5, wherein each pump includes a shroud arranged to substantially isolate the pump from the pump space, the shroud including at least one slit in fluid communication with the intake manifold.

8. The vacuum system according to claim 1, further comprising a motor that drives a pump, wherein the motor rotates about a first axis and the fan rotates about a second axis, the fan being arranged relative to the motor such that the second axis is transverse to the first axis.

9. The vacuum system according to claim 1, further comprising a motor that drives a pump, wherein the motor rotates about a first axis and the fan rotates about a second axis, the fan being arranged relative to the motor such that the second axis is at least one of perpendicular and parallel to the first axis.

10. The vacuum system according to claim 1, wherein the inlet manifold extracts ambient air from the environment and through selective adjustment delivers a first amount of air to the first bay and a second amount of air to the second bay, wherein the first amount of air is different than the second amount of air.

11. The vacuum system according to claim 5, wherein the divider includes vertical divider panel passages that allows air flow from the general equipment space to the pump space, or alternatively said vertical divider panel passages allow air flow from the pump space to the general equipment space.

12. The vacuum system according to claim 5, wherein the heated air from the pump space is extracted via the cooling exhaust manifold by the at least one fan and expelled from the vacuum system in a direction away from the inlet manifold.

13. The vacuum system according to claim 5, wherein heated air extracted by the exhaust manifold is expelled via an exhaust outlet that is disposed on a different surface of the enclosure than the inlet manifold.

14. The vacuum system according to claim 1, wherein at least one of the exhaust manifold and the inlet manifold comprise a sound absorbing material.

15. A method of generating a vacuum system, the method comprising:

enclosing a first motor and a first vacuum pump in a first pump bay and enclosing a second motor and a second vacuum pump in a second pump bay, the first pump bay and the second pump bay enclosed by an enclosure defined by a plurality of panels attached to a frame;

forming an inlet manifold through at least a portion of the enclosure to extract ambient air from the environment surrounding the enclosure and deliver the ambient air to the first and second pump bays when in use, the ambient air flowing through the first and second pump bays cools at least the vacuum pump and subsequently becomes heated air when in use;

providing a cooling opening that defines an airflow path for the ambient air between the first and second pump bays, and a baffle located in the first pump bay wherein the baffle directs air through the cooling opening; and forming an exhaust manifold through at least a portion of the enclosure, the exhaust manifold, comprising at least one fan, is in fluid communication with the first and second pump bays and the exhaust manifold is further arranged to extract the heated air from the first and second pump bays and expel the heated air back into the environment surrounding the enclosure when in use.

16. The method of claim 15, comprising arranging in each pump bay a divider to horizontally separate each pump bay into a pump space, housing one of the vacuum pump or the motor, and a general equipment space housing an other of the vacuum pump or the motor.

17. The method of claim 15, comprising arranging at least one baffle at the inlet manifold to prevent the emission of sound generated by at least one of the motor and the pump to the environment surrounding the enclosure.

18. A vacuum system comprising:

a plurality of panels attached to a frame to define an enclosure; a first pump bay and a second pump bay enclosed by the enclosure, the first pump bay and the second pump bay each including a motor and a vacuum pump driven by the motor;

an inlet manifold comprising at least one baffle arranged to prevent the emission of sound when in use, the inlet manifold, formed through at least a portion of the enclosure, in fluid communication with the first and second pump bays when in use, the inlet manifold arranged to extract ambient air from the environment surrounding the vacuum enclosure and deliver the ambient air via an approximately 90° turn to the pump bays, the ambient air flowing through the first and second bays cools at least the vacuum pump and subsequently becomes heated air when in use;

a cooling opening that connects the first and second bays and provides an airflow path between the first and second pump bays, and a baffle located in the first pump bay wherein the baffle directs air through the cooling opening; and an exhaust manifold, formed through at least a portion of the enclosure, in fluid communication with the first and second pump bays when in use, the exhaust manifold including at least one fan is arranged to extract the heated air from the first and second pump bays, wherein the heated air is directed approximately 90° to travel from the pump bays to the exhaust manifold when in use, and wherein the heated air is directed approximately 90° to be expelled into the environment at a location spaced from the inlet manifold and in a direction away from the inlet manifold when in use.

19. The vacuum system according to claim 18, wherein the motor that drives the pump comprising an oilless claw vacuum pump rotates about a first axis and the at least one fan rotates about a second axis, the fan being arranged relative to the motor such that the second axis is perpendicular to the first axis.

20. The vacuum system according to claim 18, wherein at least one of the plurality of panels and the at least one baffle is provided with a sound absorbing material.

* * * * *